US007073257B1

(12) United States Patent
Hsu

(10) Patent No.: US 7,073,257 B1
(45) Date of Patent: Jul. 11, 2006

(54) SHRINKAGE-FREE SEALING METHOD AND STRUCTURE OF HEAT PIPE

(75) Inventor: Hul-Chun Hsu, Taichung (TW)

(73) Assignee: Jaffe Limited, Tortola (VG)

( * ) Notice: Subject to any disclaimer, the term of this patent is extended or adjusted under 35 U.S.C. 154(b) by 0 days.

(21) Appl. No.: 11/082,839

(22) Filed: Mar. 18, 2005

(51) Int. Cl.
*B23P 6/00* (2006.01)

(52) U.S. Cl. ..... 29/890.032; 165/104.26

(58) Field of Classification Search ..... 165/104.33, 165/104.26; 29/890.032
See application file for complete search history.

(56) References Cited

U.S. PATENT DOCUMENTS

| | | | | |
|---|---|---|---|---|
| 3,680,189 | A * | 8/1972 | Noren | 29/890.032 |
| 6,230,407 | B1 * | 5/2001 | Akutsu | 29/890.032 |
| 6,276,444 | B1 * | 8/2001 | Li | 165/134.1 |
| 6,871,701 | B1 * | 3/2005 | Ueki et al. | 165/104.26 |
| 2005/0022414 | A1 * | 2/2005 | Hsu | 34/92 |
| 2005/0051259 | A1 * | 3/2005 | Luo | 156/198 |
| 2005/0167984 | A1 * | 8/2005 | Hsu | 285/382 |

FOREIGN PATENT DOCUMENTS

| | | | | |
|---|---|---|---|---|
| JP | 61-213599 | * | 9/1986 | 29/890.032 |
| JP | 62-166291 | * | 7/1987 | 165/177 |
| JP | 6-109384 | * | 4/1994 | 165/104.26 |
| JP | 2000-274974 | * | 10/2000 | 165/104.26 |

* cited by examiner

*Primary Examiner*—Ljiljana Ciric

(57) ABSTRACT

A shrinkage-free sealing structure is formed at an open end of a heat pipe by pressing one side of the open end towards the other side of the open end until the side walls of the open ends contact each other. Furthermore, the recess is pressed to have a curve which is the same as the curve of the outer circular wall of the heat pipe so that a double-layered recess is formed with a cross-sectional length larger than a semi-circumference of the outer circular wall of the heat pipe.

3 Claims, 7 Drawing Sheets

SHRINKAGE-FREE SEALING METHOD AND STRUCTURE OF HEAT PIPE

BACKGROUND OF THE INVENTION

The present invention relates to a shrinkage-free sealing method and structure of a heat pipe, and more particular, to a method and a structure which seals one open end of a heat pipe without performing shrinkage process thereof, so that the sealed open end can still assemble with heat-dissipation fins.

As shown in FIG. 1, the conventional sealing structure of a heat pipe 1*a* is performed by shrinking the open end portion of the heat pipe 10*a* into a shrunk end portion 100*a*, and a sealing module is used to clamp the terminus of the shrunk end portion 100*a*, such that a flattened region 101*a* is formed. The edge of the flattened region 101*a* is then soldered to ensure an airtight sealing effect.

However, the objective for shrinking the end portion 10*a* into the shrunk end portion 100*a* is to decrease the volume and area of the sealing structure, such that it is advantageous for the subsequent soldering process. However, the shape of the shrunk end portion 10*a* will make the heat pipe 1*a* with one open end useless to connect the heat-dissipation fins. Therefore, the shrunk end portion 10*a* has to protrude out of fins to occupy space.

To resolve the problems caused by the conventional heat pipe structure as described above, the Applicant, with many years of experience in this field, has developed a shrinkage-free sealing method and structure of heat pipe as described as follows.

BRIEF SUMMARY OF THE INVENTION

The present invention provides a shrinkage-free sealing method and structure of a heat pipe to resolve the problems of the conventional sealing structure, so that the sealed open end of the heat pipe can still connect with heat-dissipation fins. As a result, the heat pipe can be assembled with more heat-dissipation fins to prevent conventional useless shrunk end portion protruding therefrom.

The method of forming a sealing structure at an open end of a heat pipe includes pressing one side of the open end towards the other side of the open end until the sidewall of the open end contact with each other so that a double-layered recess is formed with a cross-sectional length larger than a semicircumference of the outer circular wall of the heat pipe.

The shrinkage-free sealing structure of a heat pipe includes a double-layered recess formed at an open end of the heat pipe with the sidewall of the open end contacting with each other, wherein a cross-sectional length of the recess is larger than a semicircumference of the outer circular wall of the heat pipe.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

These, as well as other features of the present invention, will become apparent upon reference to the drawings wherein.

DETAILED DESCRIPTION OF THE INVENTION

Figure 1:
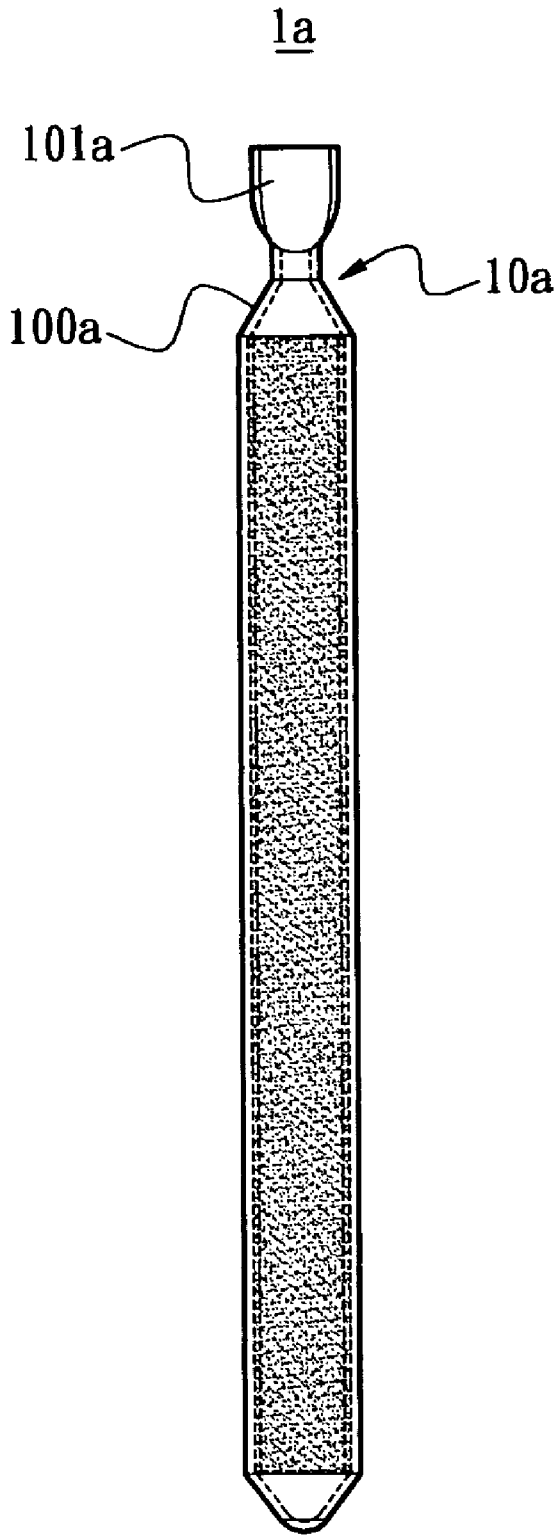
FIG. 1 PRIOR ART
FIG. 1 shows a side view of a conventional heat pipe.

Reference will now be made in detail to the preferred embodiments of the present invention, examples of which are illustrated in the accompanying drawings. Wherever possible, the same reference numbers are used in the drawings and the description to refer to the same or like parts.

Figure 2:
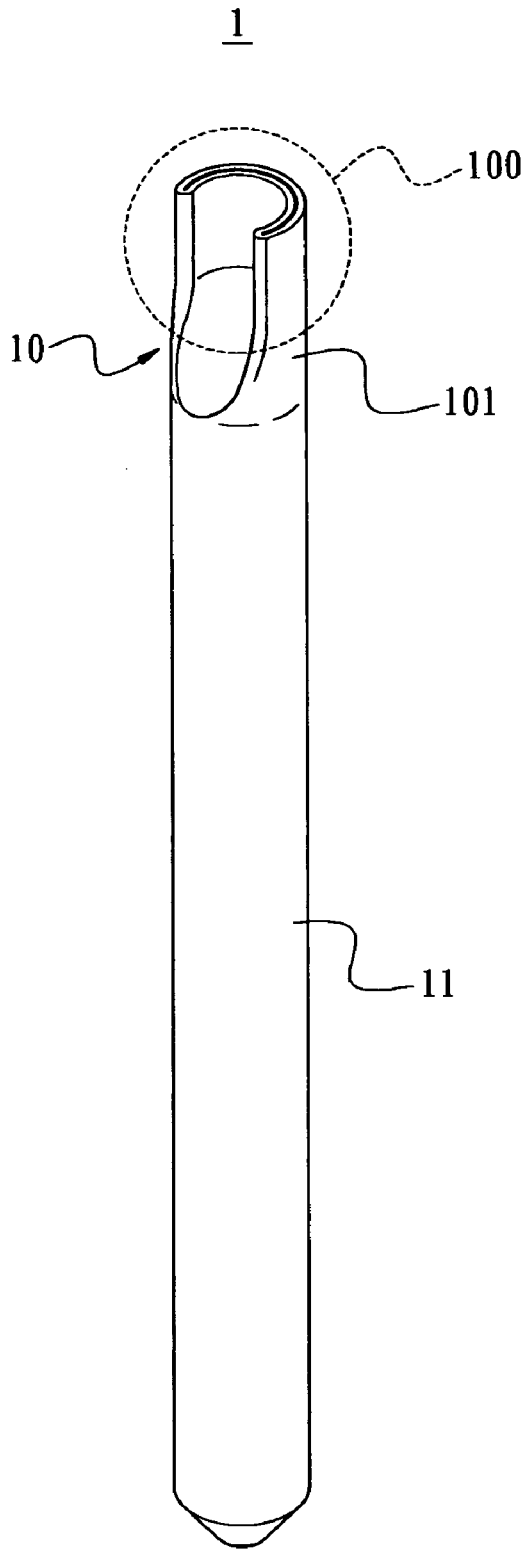
FIG. 2 shows a perspective view of a heat pipe having a sealing structure provided by the present invention.
Figure 8:
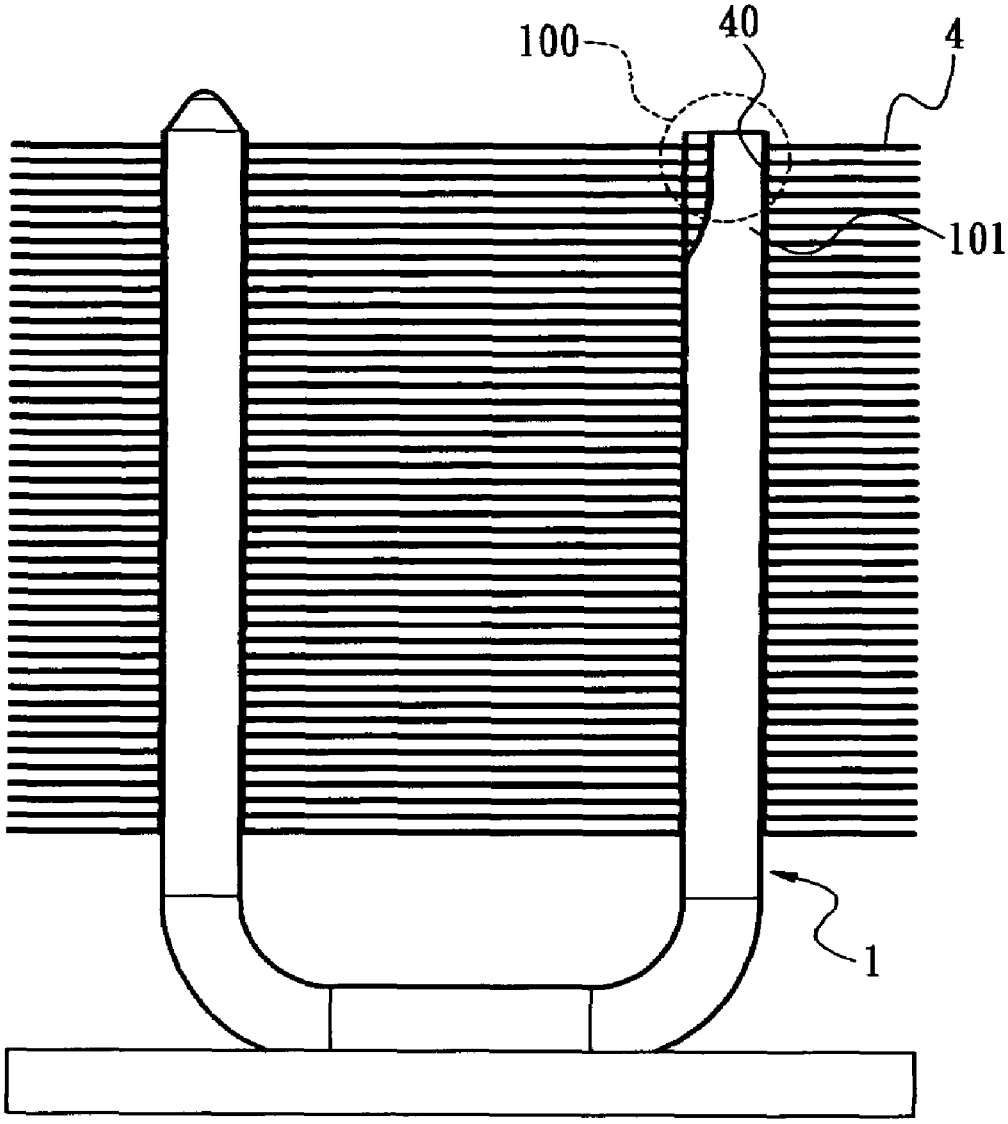
FIG. 8 shows the heat pipe of the present assembled with heat-dissipation fins.

Referring to FIG. 2, a perspective view of a sealing structure provided by the present invention is illustrated. The heat pipe 1 includes an open end 10 to be sealed by the sealing structure, such that the interior of the heat pipe is airtight, and the working fluid can properly perform phase transition, allowing a normal operation of the heat pipe. Meanwhile, the sealed open end 10 is still useful for the heat-dissipation fins 4 (as shown in FIG. 8) to connect thereon.

To prepare the sealing structure, the open end 10 of the heat pipe 1 is processed as follows.

Figure 3:
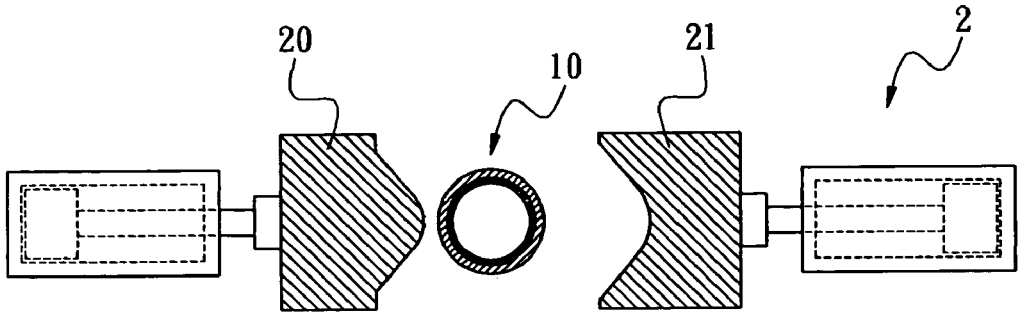
FIG. 3 shows a top view of the heat pipe disposed between a press module.
Figure 4:
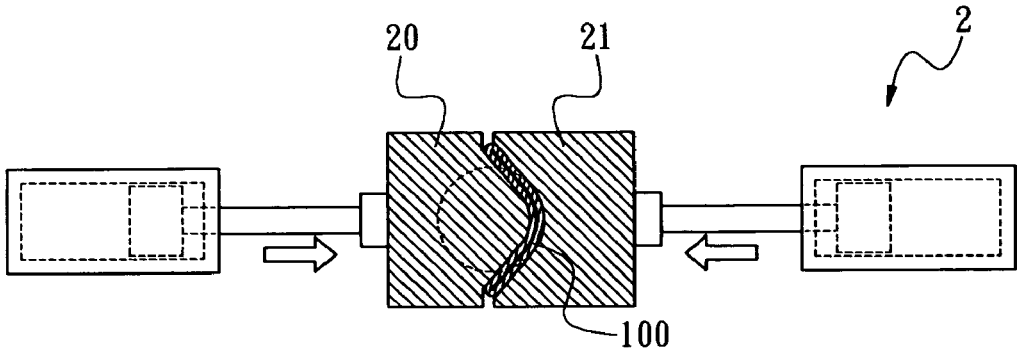
FIG. 4 shows a top view of the heat pipe with an open end sealed by the press module.

As shown in FIGS. 3 and 4, the open end 10 of the heat pipe 1 is disposed in a press module 2 which includes a first mold 20 and a second mold 21. The first mold 20 has a convex contact, while the second mold 21 has a concave contact. Therefore, by placing the open end 10 of the vertically extending heat pipe between the first mold 20 and the second mold 21 and pressing the first mold 20 towards the second mold 5, one side of the open end 10 is pressed towards the other side of the open end. After the sidewall of the open end 10 are completely pressed with each other, a recess portion 100 is formed having a double-layered cross section, and most importantly the recess portion 100 has a cross-sectional length larger than a semicircumference of the outer circular wall 11 (as labeled in FIG. 2) of the heat pipe 1, as shown in FIG. 4.

Furthermore, a soldering process can be performed at the edge of open end 10 to obtain a more reliable sealing structure. Otherwise, a supersonic welding can be used to press the open end 10 to form the recess portion 100.

Figure 5:
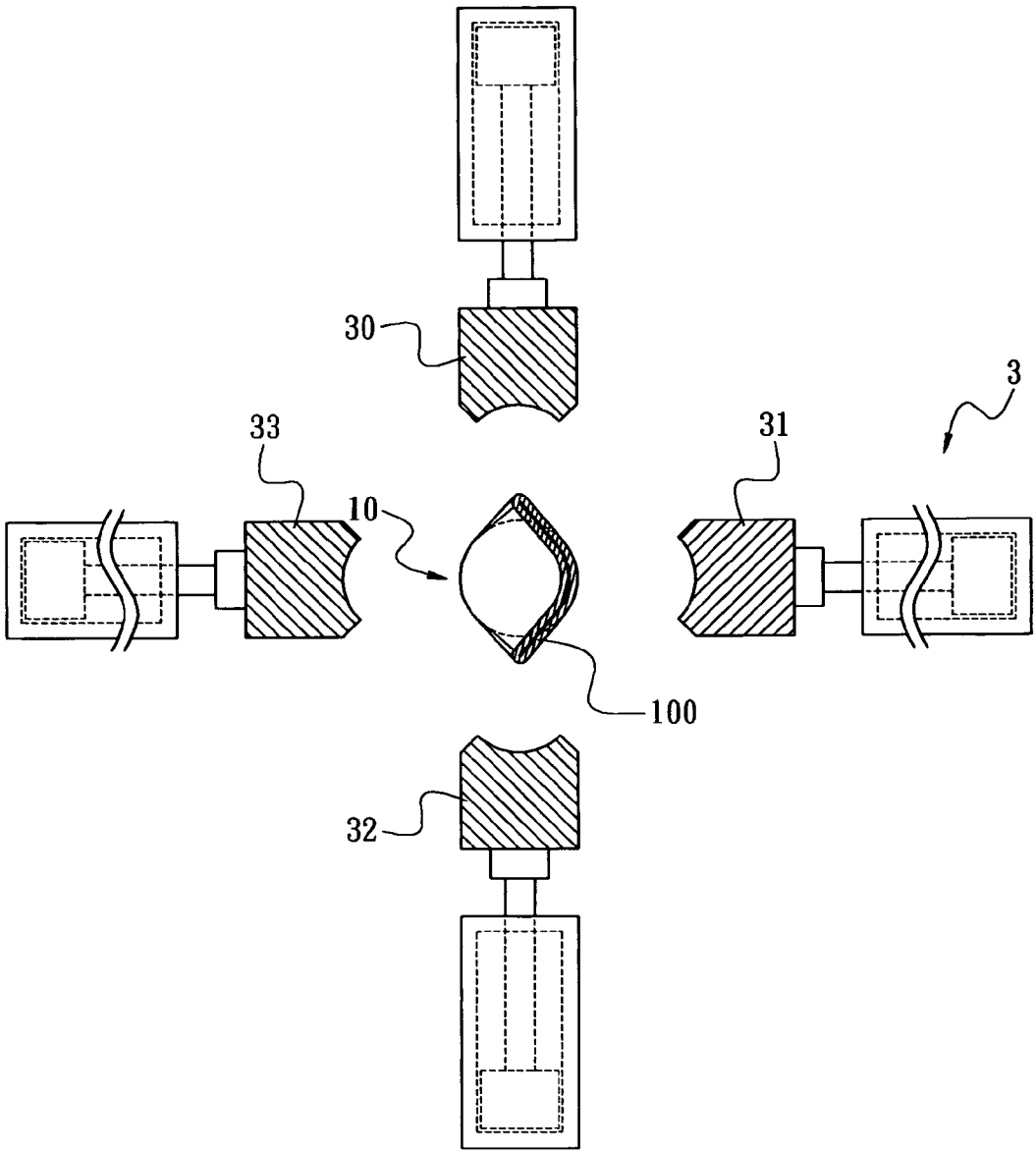
FIG. 5 shows a top view of the heat pipe disposed within a former module.
Figure 6:
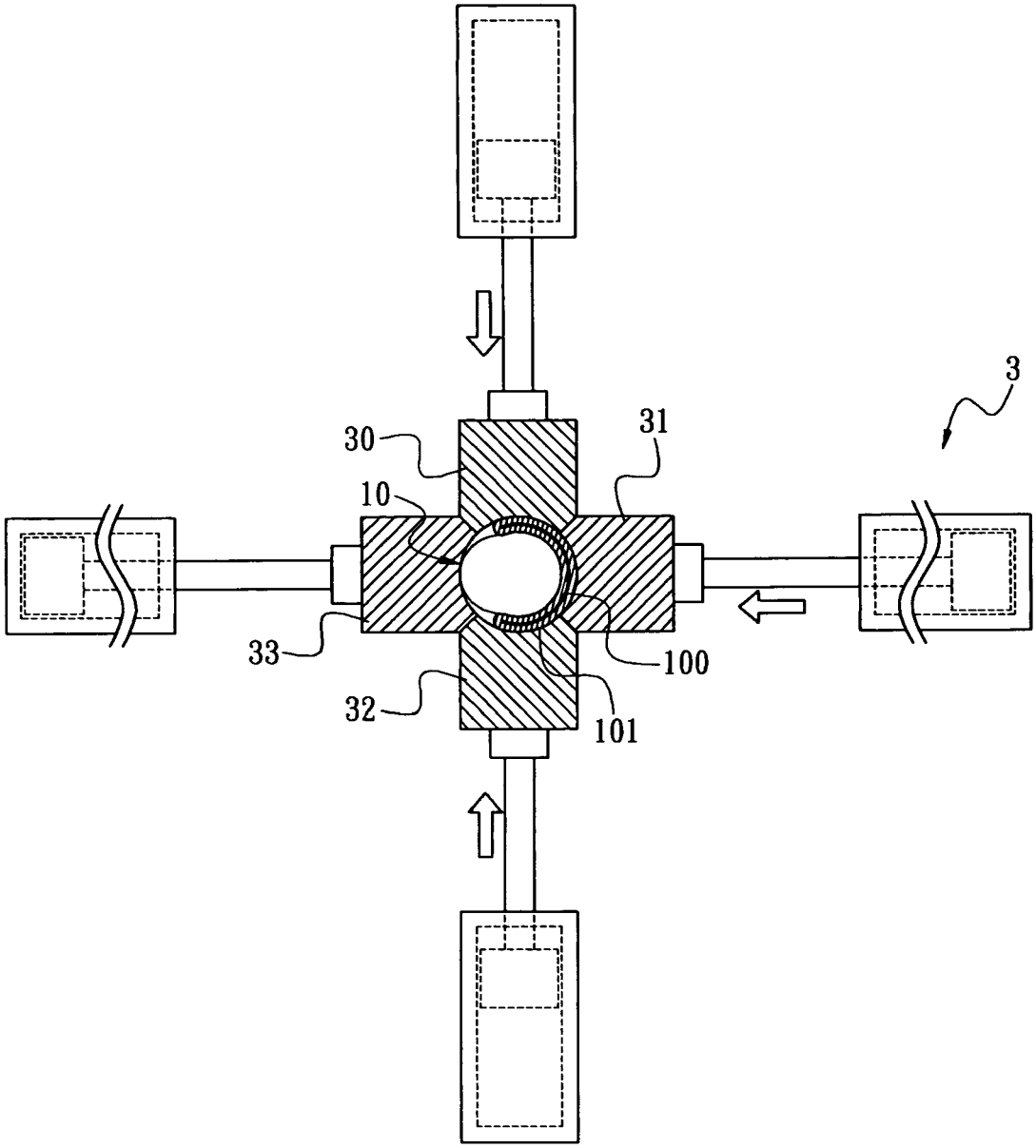
FIG. 6 shows a top view of the heat pipe formed the sealing structure by the former module.
Figure 7:
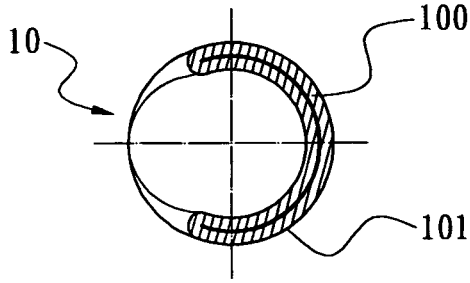
FIG. 7 shows a top view of the heat pipe with the sealing structure.

As shown in FIGS. 5 and 6, the heat pipe 1 is further placed in a forming module 3 having four molds 30, 31, 32 and 33. Similarly, the heat pipe 1 extends vertically, while the pressed open end 10 is placed between the four molds 30, 31, 32 and 33. Each mold 30, 31, 32 or 33 has a concave contact so that the recess portion 100 can be formed with a curve 101 as same as the outer circular wall 11 has when the four molds 30, 31, 32 and 33 are combined together. Due to the cross-sectional length of the recess portion 100 is larger than the semicircumference of the outer circular wall 11, a perimeter of the curve 101 will exceed the semicircumference of the outer circular wall 11, as shown in FIG. 7.

Furthermore, if no soldering process is performed before, it still has chance to do at this time to solder the end of the recess portion 100 with the better sealing structure.

Accordingly, a shrinkage-free sealing structure of the present invention can be obtained for use to connect with the heat-dissipation fins as shown in FIG. 8. As the perimeter of the curve 101 exceeds the half circumference of the outer circular wall 11, the sealed open end 10 of the heat pipe 1, like other portion of the heat pipe 1, can securely fit to the holes 40 of the heat-dissipation fins 4. Moreover, the formation of the curve 101 enhances the open end 10 to contact with the heat-dissipation fins 4 so that the heat pipe 1 can be assembled with more heat-dissipation fins without conventional useless shrunk end portion protruding out of the fins to occupy more space.

Figure 9:
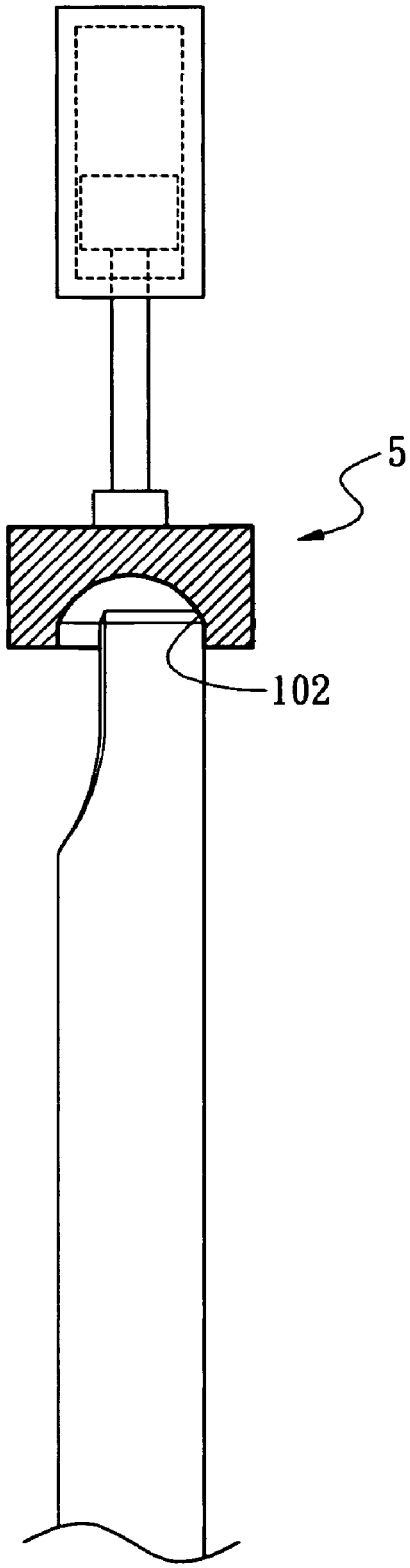
FIG. 9 shows a side view of the heat pipe with the sealed open end formed a leading edge.

Furthermore, as shown in FIG. 9, in order for sealed open end 10 of the heat pipe 1 to be easily assembled to the heat-dissipation fins 4, another former module 5 is provided to press the recess portion 100 with a leading edge 102.

This disclosure provides exemplary embodiments of the present invention. The scope of this disclosure is not limited by these exemplary embodiments. Numerous variations, whether explicitly provided for by the specification or implied by the specification, such as variations in shape, structure, dimension, type of material or manufacturing process may be implemented by one of skill in the art in view of this disclosure.

What is claimed is:

1. A method of forming a sealing structure at an open end of a heat pipe, comprising:

pressing one side of the open end towards the other side of the open end by a press module including a first mold with a convex contact and a second mold with a concave contact until the side walls of the open ends contact each other so that a double-layered recess is formed with a cross-sectional length larger than a semicircumference of an outer circular wall of the heat piper; and placing the pressed open end in a forming module including four molds each having a concave contact so that the recess is formed with a curve which is the same as the curve that the outer circular wall has when the four molds am combined together, thereby, due to the cross-sectional length of the recess being larger than the semicircumference of the outer circular wall, a perimeter of the curve will exceed the semicircumference of the outer circular wall.

2. The method of claim 1, further comprising pressing the open ends by a supersonic welding to form the recess.

3. The method of claim 1, further comprising soldering the edges of the pressed open ends.

* * * * *